US007094090B2

(12) United States Patent
He et al.

(10) Patent No.: US 7,094,090 B2
(45) Date of Patent: Aug. 22, 2006

(54) ZERO-INSERTION-FORCE CONNECTOR

(75) Inventors: Wen He, Kunsan (CN); Fujin Peng, Kunsan (CN); Nick Lin, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/025,334

(22) Filed: Dec. 28, 2004

(65) Prior Publication Data

US 2005/0215094 A1 Sep. 29, 2005

(30) Foreign Application Priority Data

Mar. 26, 2004 (TW) ..... 93108260 A

(51) Int. Cl.
*H01R 13/62* (2006.01)

(52) U.S. Cl. ..... 439/342; 439/259; 439/270

(58) Field of Classification Search ..... 439/342, 439/263, 270, 259
See application file for complete search history.

(56) References Cited

U.S. PATENT DOCUMENTS 5,383,272 A 1/1995 Mattingly et al.
6,146,178 A 11/2000 Wallkup et al.
6,250,941 B1 6/2001 Huang et al.
6,280,224 B1 * 8/2001 Huang ..... 439/342
6,338,640 B1 * 1/2002 Lin ..... 439/342
6,419,514 B1 7/2002 Yu
6,692,280 B1 * 2/2004 Renfro et al. ..... 439/342
6,733,321 B1 * 5/2004 Okita et al. ..... 439/342

FOREIGN PATENT DOCUMENTS

TW 579107 3/2004

* cited by examiner

*Primary Examiner*—Briggitte R. Hammond
(74) *Attorney, Agent, or Firm*—Wei Te Chung

(57) ABSTRACT

A connector (10) comprises a base (20), a cover (30), a protecting mechanism (35) and an actuator (40). The base defines a plurality of through holes (21) therein for receiving a plurality of contacts. The cover movably mounted on the base defines a plurality of passages in alignment with the through holes of the base. The protecting mechanism in the cover defines a hole extending therethrough, two stop members (341,342) are formed in inner surface of the hole. The actuator that can actuate the cover slide on the base, is rotatably assembled with the base and the protecting mechanism. The actuator has a protrusion thereon abuttable against either of the stop members during operation of the actuator, and is departed completely from the cover by the protecting mechanism.

19 Claims, 6 Drawing Sheets

ZERO-INSERTION-FORCE CONNECTOR

BACKGROUND OF THE INVENTION

1. Field of the Invention

The present invention relates to a zero-insertion-force (hereafter ZIF) connector.

2. Description of Related Art

Central processing unit (CPU) sockets are widely used in personal computer (PC) systems to electrically connect integrated circuit (IC) chips with printed circuit boards (PCBs), pins in the IC chips increase accordingly. To mount a CPU socket with so many pins to a connector needs a very large inserting force. Such a large inserting force will cause a difficulty to mount/dismount the CPU socket or contacts of the CPU sockets if there is a deviation of positional precision of the pins or the contacts. Thus, a ZIF connector is developed, when it is at an open position the pins of the IC chip can be freely inserted into the CPU socket without engagement with the contacts, when it is at an closed position the pins of the IC chip can engage with the contacts so that an electrical connection is achieved between the IC chip and the PCB. The ZIF connector is motivated by an actuator thereof to a closed position thereby moving the pins to engage with the contacts.

The conventional ZIF connector comprises a plastic base, a plastic cover slidably mounted onto the base, a plurality of electrical contacts received in the base, and a metallic actuator. The plastic cover is actuated to slide on the plastic base by rotating of the metallic actuator, thereby causing pins of integrated circuit chip mounted on the cover to engage/disengage with the contacts in the plastic base. The plastic cover defines a circular-shaped recess in one side thereof. Two stop walls are formed in the inner surface of the circular-shaped recess. The metallic actuator comprises a lateral protruding protrusion. The protrusion of the actuator is rotatable in the circular-shaped recess. Rotation of the actuator causes the plastic cover to slide on the plastic base, mating or unmating the pins of the integrated circuit chip on the cover with the contacts of the plastic base.

However, when the protrusion of the actuator rotates between two limit positions defined by the stop walls and abuts against one of the stop walls, the large force exerted by the protrusion may tend to damage the stop walls during operation because the metallic material has a higher strength than the plastic material, thereby causing malfunction of the ZIF connector. Further, the plastic cover tends to be worn out by the rotation of the metallic actuator therein, resulting in a shortened life thereof, and in turn a shortened life of the connector. The disadvantages as above of this type of connector is existed in U.S. Pat. No. 6,146,178, which can not escape from the risk of damaging the plastic cover of the connector.

Hence, an improved ZIF connector is desired to overcome the disadvantages and problems of the prior art.

SUMMARY OF THE INVENTION

An object of the present invention is to provide an improved ZIF connector having a protecting mechanism which can prevent the connector from being damaged.

To achieve the above object, a ZIF electrical connector in accordance with the present invention comprises a base, a cover, a protecting mechanism and an actuator. The base defines a plurality of through holes therein for receiving a plurality of contacts. The cover movably mounted on the base defines a plurality of passages in alignment with the through holes of the base. The protecting mechanism in the cover defines a hole extending therethrough, two stop members are formed in inner surface of the hole. The actuator that can actuate the cover slide on the base is rotatably assembled with the base and the protecting mechanism. The actuator has a protrusion thereon abuttable against either of the stop members during operation of the actuator, and is departed completely from the cover by the protecting mechanism. The one of the stop members when the protrusion is abutting against can endure a large force exerted by the protrusion, therefore, the over rotation of the actuator is prevented. Furthermore, the protecting mechanism is made of high strength material such as metallic material can give a long life of the protecting mechanism, and in turn give a long life for the connector.

In the present invention, said protecting mechanism can comprise an upper part insert molded in the cover and a lower part insert molded in the base, the actuator is assembled with the protecting mechanism, thereby, actuating the cover slide on the base. The actuator is departed completely from the cover and the base by the protecting mechanism.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiments of the present invention.

Figure 1:
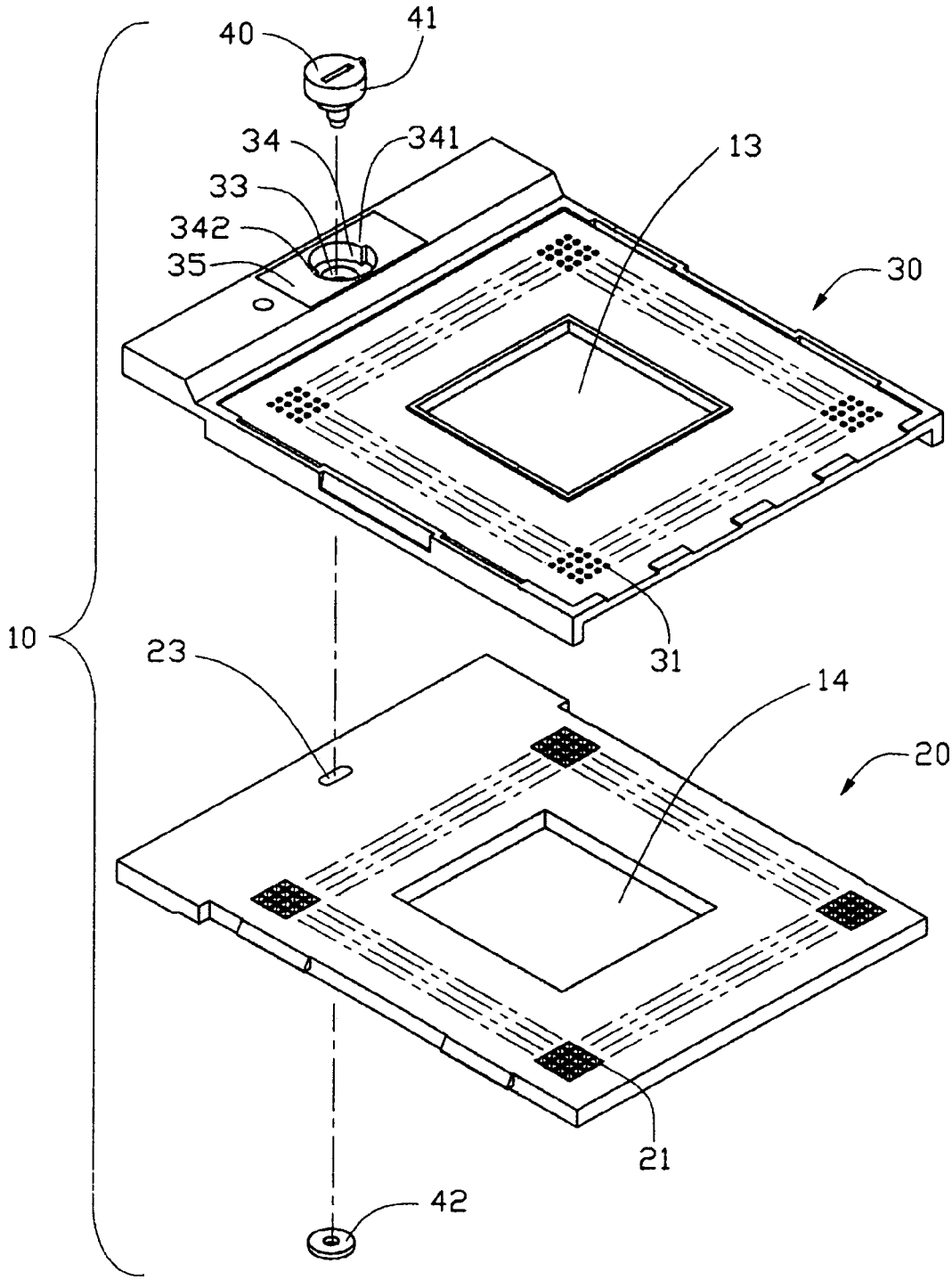
FIG. 1 is an exploded, perspective view of a ZIF electrical connector in accordance with an embodiment of the present invention.
Figure 2:
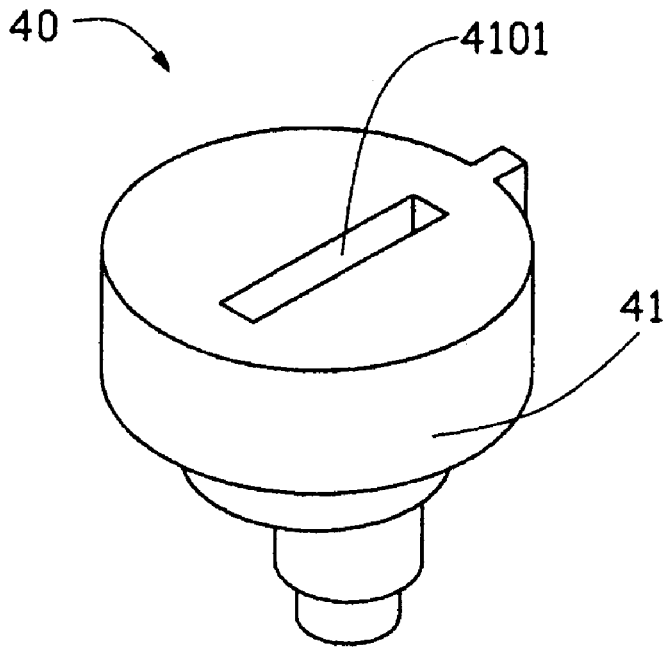
FIG. 2 is an enlarged, perspective view of an actuator of the ZIF connector of FIG. 1.

In an embodiment, please referring to FIGS. 1–2, a ZIF electrical connector 10, for connecting an integrated circuit (IC) chip (not shown) to a printed circuit board (PCB) (not shown) in accordance with the present invention, comprises a base 20, a cover 30 slidably mounted on the base 20, a protecting mechanism 35 insert molded in the cover 30, and an actuator (in this embodiment it is a cam actuator, hereafter cam actuator) 40.

The base 10 is made of a material with low strength such as a plastic material. The base 10 has a plurality of through holes 21 therein for receiving plurality of contacts (not shown) connected to the circuit board, is generally square in shape. The base 10 defines an elongated square aperture 23 extending therethrough in one end thereof, a square opening 14 in the middle thereof.

Figure 5:
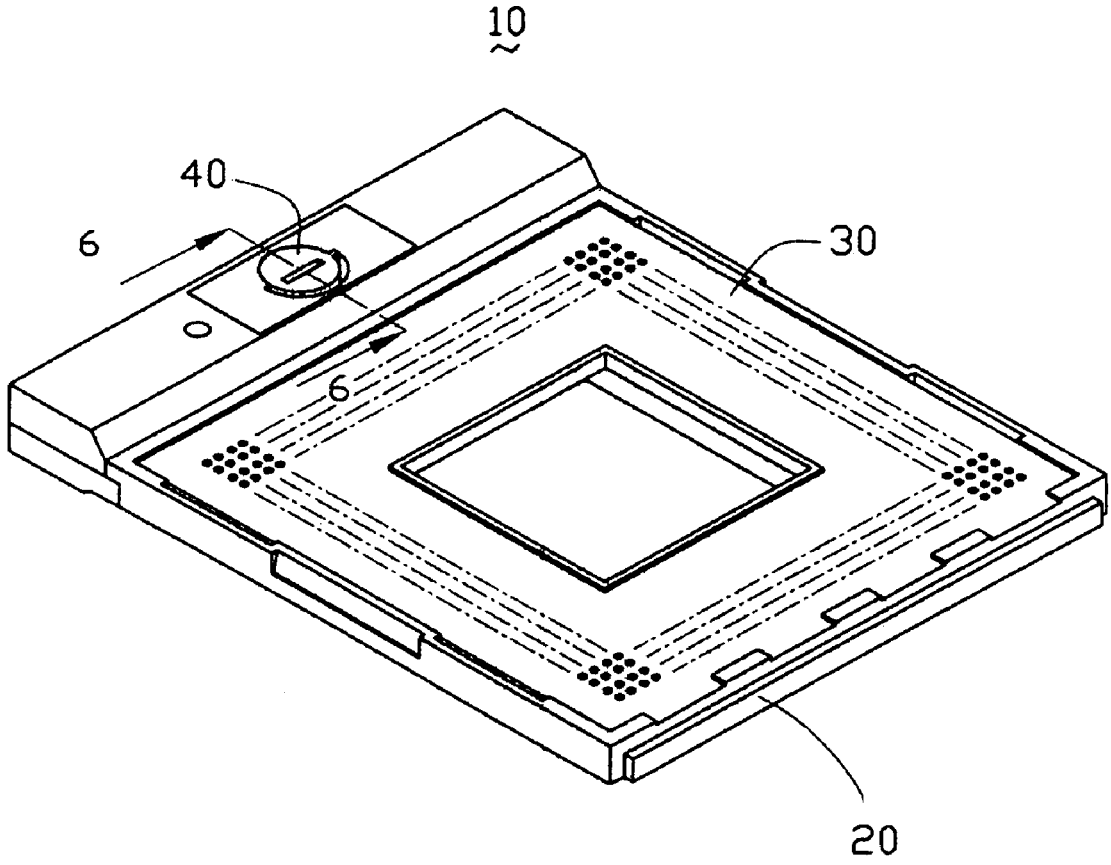
FIG. 5 is an assembled view of FIG. 1.
Figure 6:
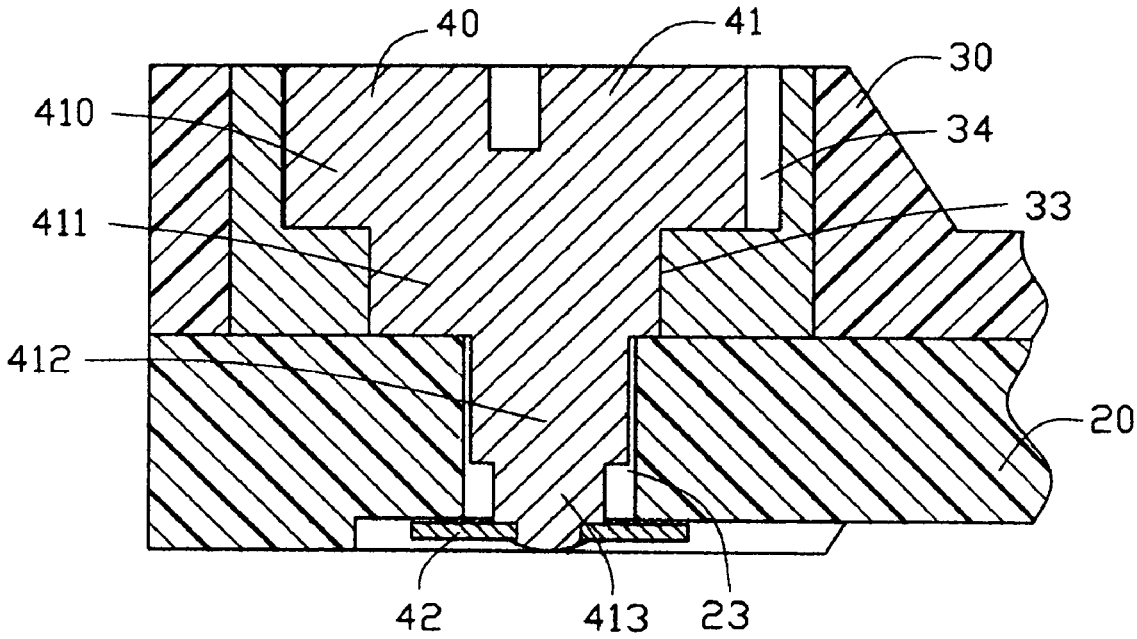
FIG. 6 is a cross section view taken from line 6—6 of FIG. 5.

Referring to FIG. 1 and FIG. 5, the cover 30 slidablely mounted on the base 10 between open and closed positions is made of a material with low strength such as plastic material. The cover 30 has a square shape corresponding to that of the base 20, defines an opening 13 in the middle thereof corresponding to the opening 14 of the base 10, and a plurality of passages 31 in alignment with the through holes 21 of the base 20. The IC chip is mounted on the cover 30 and pins (not shown) of the IC chip is received in the passages 31 and can electrically connect with contacts of the base 20.

Figure 4:
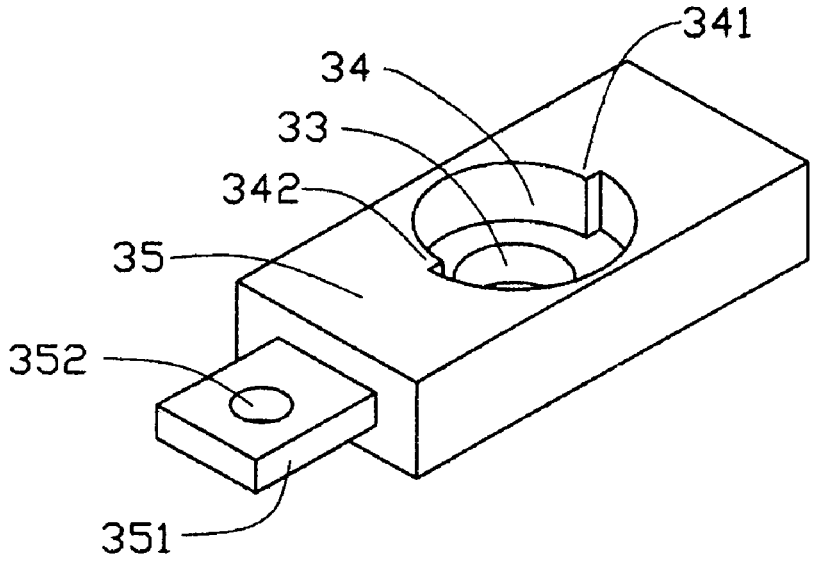
FIG. 4 is a perspective view of a protecting mechanism of FIG. 1.

Referring to FIG. 4, the protecting mechanism 35 insert molded in the cover 30 is made of a material with a high strength such as metallic material. The protecting mechanism 35 defines a hole (not labeled) extending therethrough, the hole is divided into an actuation hole 33 and a receiving hole 34. The actuation hole 33 in a shape of circular is at a lower position of the protecting mechanism 35 near the base 20 and corresponding to the position of the aperture 23 of the base 20. The receiving hole 34 is communicated with the actuator hole 33 and at an upper position of the protecting mechanism 35 that is far from the base 20. The receiving hole 34 is formed from two coaxial semicircle-shaped holes of different diameters, a pair of opposite stop members 341, 342 are formed at the junction of an inner surface of the two semicircle-shaped holes. The protecting mechanism 35 has a tail portion 351 in one end thereof, a circular through hole 352 is formed in the middle of the tail portion 351 for orientation of the protecting mechanism 35 when it is insert molded in the cover 30.

Figure 3:
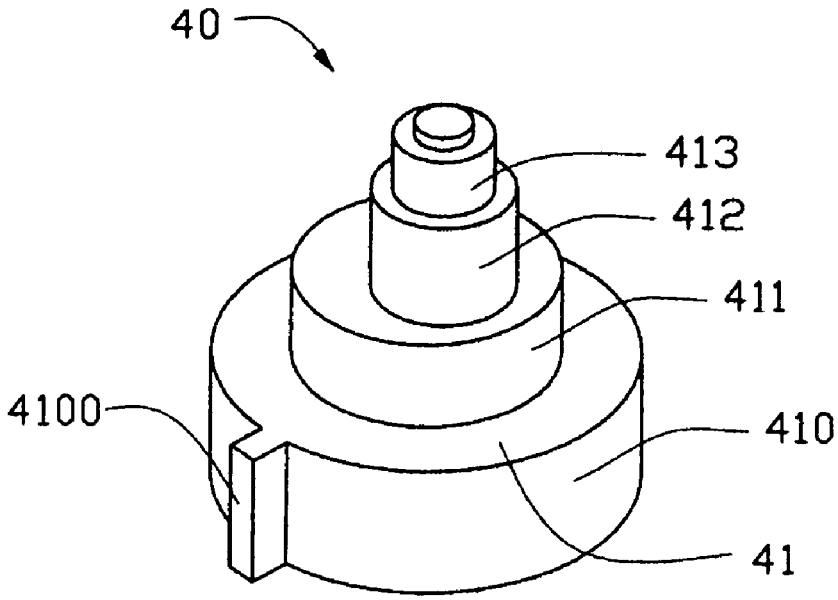
FIG. 3 is a perspective view of the actuator of FIG. 2 at another aspect.

Referring to FIGS. 2–3, the cam actuator 40 is made of a high strength material such as metallic material. The cam actuator 40 comprises an upper portion 41 and a cam block 412. The upper portion 41 is composed of an upper disk 410 and a lower disk 411 coaxial with the upper disk 410. The upper disk 410 has a diameter larger than that of the lower disk 411 and substantially equal to that of the semicircle-shaped hole with a smaller diameter. The upper disk 410 defines an elongated groove 4101 recessed from the upper surface thereof and a lateral protrusion 4100 protruding from the axis a lateral side (not labeled) thereof. The elongated groove 4101 is closed with a pair of walls (not labeled) on the opposite longitudinal ends thereof to confine an external tool (not shown) fitted therein and prevent the tool slide beyond the periphery of the upper surface of the upper disk 410. The cam block 412 is formed under the upper portion 41 and comprises a riveting end 413. The axis of the cam block 412 is parallel to but offset from the axis of the upper portion 41.

Referring to FIG. 1 to FIG. 6, in assembly, the cover 30 is slidable mounted on the base 20, the cam actuator 40 is inserted into the protecting mechanism 35, the protecting mechanism 35 completely departs the cam actuator 40 from the cover 30. The upper disk 410, the lower disk 411, the cam block 412 of the cam 40 are received in the receiving hole 34, the actuation hole 33, the aperture 23, and the riveting end 413 is riveted by a washer 42 on a lower face of the base 20. The washer 42 is made of a metallic or other suitable material.

In operation, after the integrated circuit chip is loaded on the cover 30, the external tool (not shown) is fitted into the groove 4101 to rotate the cam actuator 40 until the lateral protrusion 4100 engages with either of the stop members 341,342 of the protecting mechanism 35. Since the axis of the cam block 412 is offset from the upper portion 41, the rotation of the cam actuator 40 forces the cover 30 to slide along the base 20 in a diagonal direction, thereby making the pins of the integrated circuit chip engage with the contacts in the through holes 21. To open the ZIF connector contact connection, the cam actuator 40 is rotated in an opposite direction from one of the two stop members 341, 342, to the other stop members 341, 342, thereby disengaging the pins of the IC chip from the contacts of the ZIF connector 10 and allowing the IC chip to be removed from the cover 30.

the protecting mechanism 35 is insert molded in the cover 30, so that the connection between the protecting mechanism 35 and the cover 30 is reliable. The stop members 341, 342 engage with the lateral protrusion 4100 of the cam actuator 40 to stop rotation of the cam actuator 40, thereby avoiding over-rotation of the cam actuator 40 and safeguarding the contacts of the ZIF connector 10 and the pins of the integrated circuit chip from being damaged. The protrusion 4101 can rotate between the two stop members 341, 342 and abut against the stop members 341, 342, the one which the protrusion 4101 is abutting against will endure a large force exerted by the protrusion 4101, thereby preventing the over rotation of the cam actuator 40 and protecting the cover 30. Furthermore, since the protecting mechanism 35 made of high strength material, it can give a longer life than the prior art of the plastic cover, and in turn give the ZIF connector 10 a longer life.

Figure 7:
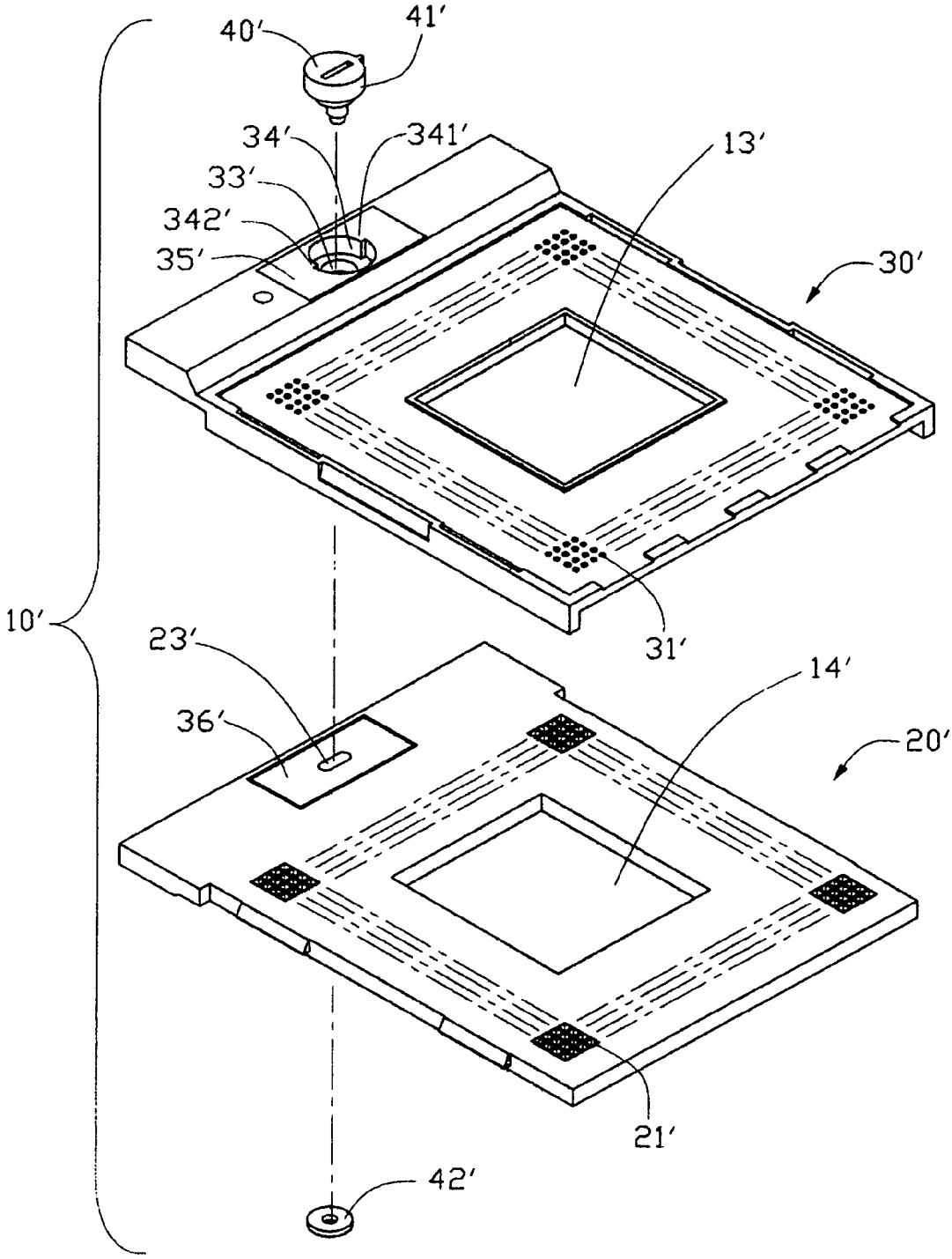
FIG. 7 is an exploded, perspective view of a ZIF electrical connector according to another embodiment of the present invention.
Figure 8:
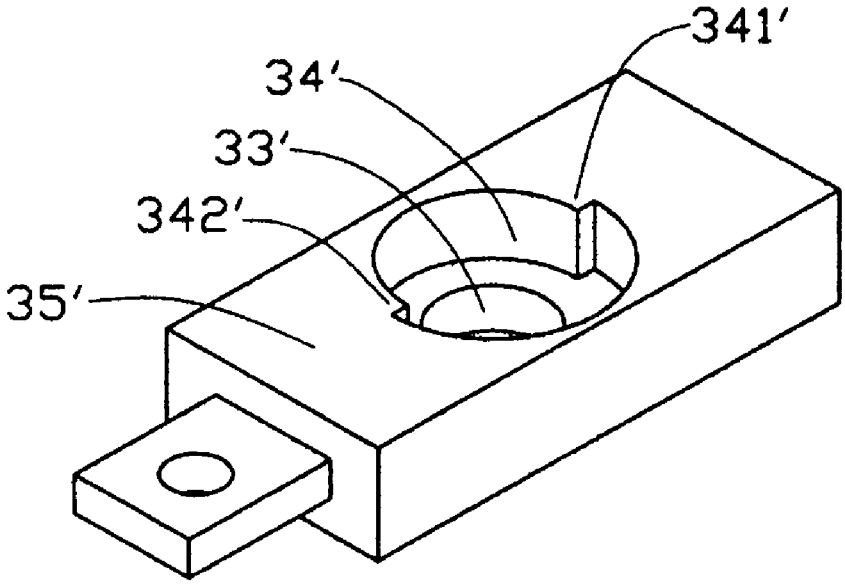
FIG. 8 is a perspective view of a protecting mechanism of FIG. 7.
Figure 8:
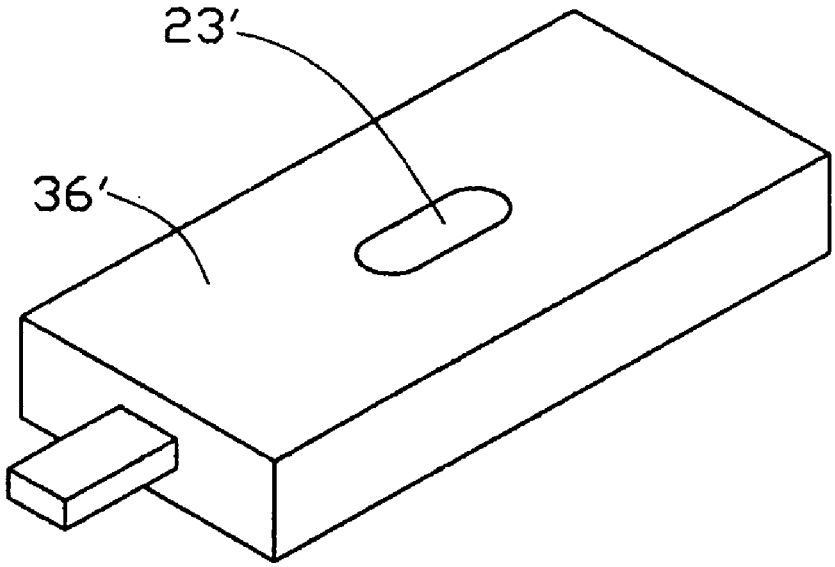

In another embodiment, please referring to the FIG. 7 and FIG. 8, a ZIF connector 10' comprises a base 20' defining a plurality of through holes 21' and an opening 14' in the middle thereof, a cover 30' slidably mounted on the base 20', a protecting mechanism (not labeled), and an actuator 40' for moving the cover 30' relative to the base 20'. The cover 30' defines a plurality of passages 31' in alignment with the through hole 21' of the base 20' and an opening 13' in the middle thereof corresponding to the opening 14' of the base 20'. The protecting mechanism is composed of an upper part 35' insert molded in the cover 30' and a lower part 36' insert molded in the base 20'. The upper part 35' defines a through hole 33', two stop members 341', 342' are formed in the inner surface 34' of the hole 33'. The lower part 36' defines an elongated square aperture 23' in the middle thereof. The actuator 40' is assemble with the upper part 35' and the lower part 36'. The actuator 40' has an upper portion 41' and a lower portion (not labeled), the upper portion 41' and the lower portion are respectively received in the hole 33' of the upper part 35', the aperture 23' of the lower part 36', and then riveted by a washer 42'. The actuator 40' has a protrusion (not labeled) can engage with the two stop members (341', 342') in order to prevent the over rotation of the actuator 40'. The actuator 40' is departed completely from the cover 30' and the base 20' by the protecting mechanism, therefore, the force exerted by the actuator 40' is completely endured by the protecting mechanism, furthermore, the base 20' and the cover 30' are protected.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. Such as the actuator can be composed of a shaft rotatably engaged between the base and the cover, and a handle. The protecting mechanism insert molded in the base defines a transverse channel at on end thereof, the channel receiving the shaft therein.

We claim:

1. A connector comprising:

a base defining a plurality of through holes therein for receiving a plurality of contacts;

a cover movably mounted on the base, and defining a plurality of passages therethrough in alignment with the through holes of the base;

a protecting mechanism in the cover comprising a hole therethrough and two stop members formed on an inner surface of the hole; and an actuator actuating the cover to slide on the base and rotatably assembled with the base and the protecting mechanism, the actuator having a protrusion thereon abuttable against one of the stop members, the actuator being separated from the cover by the protecting mechanism;

wherein the actuator comprises an upper portion and a cam block, an axis of the cam block being parallel to but offset from an axis of the upper portion, the upper portion comprises an upper disk and a lower disk under the upper disk, the hole of the protecting mechanism is divided into a receiving hole and an actuation hole, and the base comprises an aperture extending therethrough, the upper disk, the lower disk, the cam block are respectively received in the receiving hole, the actuation hole, and the aperture.

2. The connector in accordance with claim 1, wherein the protrusion of the actuator is formed on the upper disk, the receiving hole is formed from two coaxial semicircle-shaped holes of different diameters, the two stop member are formed at the junction of the inner surface of the two semicircle-shaped holes.

3. The connector in accordance with claim 1, wherein the protecting mechanism has a tail portion at one end thereof for orientation of the protecting mechanism when insert molded in the cover.

4. The connector in accordance with claim 1, wherein the upper disk of the actuator defines an elongated groove recessed from an upper surface thereof in order to confine an external tool fitted therein and preventing the tool from sliding beyond the periphery of the upper surface of the upper disk.

5. The connector in accordance with claim 1, further comprising a washer, the cam block comprises a riveting end riveted to the washer.

6. The connector in accordance with claim 1, wherein the upper disk has a diameter larger than that of the lower disk.

7. The connector in accordance with claim 1, wherein the base defines a square opening in the middle thereof, the cover defines an opening in the middle thereof corresponding to the opening of the base.

8. The connector in accordance with claim 1, wherein the protecting mechanism is insert molded in the cover and is made of a material with a strength which is higher than the cover.

9. The connector in accordance with claim 8, wherein the actuator is made of strength material higher than the cover.

10. An electrical connector comprising:

an insulative base defining a plurality of through holes therein for receiving a plurality of contacts;

an insulative cover movably mounted on the base, and defining a plurality of passages therethrough in alignment with the through holes of the base;

a protecting mechanism embedded with the cover; and an actuator assembled with the base and the protecting mechanism and having a top head in the cover, said actuator rotatable about an vertical axis to actuate the cover to slide on the base along a front-to-back direction, the top head of the actuator being essentially surrounded and separated apart from the cover by the protecting mechanism and the actuator only engaged with said protecting mechanism instead of said cover during rotation of the actuator; wherein said protecting mechanism defines a strength greater than that of the cover.

11. The connector in accordance with claim 10, wherein in a direction parallel to the axis, the head comprises an upper larger body, and a lower smaller body below the upper body, correspondingly, the through hole is configured with an upper larger section and a lower smaller section, the upper and lower sections com receiving the upper and lower bodies, respectively.

12. The connector in accordance with claim 10, wherein the protecting mechanism defines a through hole, the head of the actuator is received in the through hole.

13. The connector in accordance with claim 12, wherein the head is formed with a stopper, the stopper engagingly mates with the protecting mechanism to restrain sliding of the cover on the base in a predetermined distance range in said front-to-back direction.

14. The connector in accordance with claim 13, wherein said mating of the stopper with the protecting mechanism is kept in the through hole during rotation of the actuator.

15. An electrical connector comprising:

a base defining a plurality of through holes therein for receiving a plurality of contacts;

a cover movably mounted on the base, and defining a plurality of passages corresponding to the plurality of through holes;

a protecting mechanism comprising an upper part assembled with the cover, the upper part defining a hole comprising an upper section and a lower section;

an actuator being rotatable around an axis to drive the cover to slide on the base and being assembled with the protecting mechanism and the base, the actuator having an upper segment received in the hole, the upper segment being configured with an upper portion and a lower portion in a direction parallel to said axis; and wherein the upper and lower sections of the hole define cross-sections thereof vertical to said axis and different from each other in size, the upper and lower portions of the actuator are received in the upper and lower sections of the hole, respectively, thereby separating the actuator apart from the cover by the protecting mechanism.

16. The connector in accordance with claim 15, wherein the protecting mechanism further comprises a lower part assembled with the base to separate the actuator apart from the base.

17. The connector in accordance with claim 15, wherein the cover defines a cavity with an inner surface, the cavity receiving the upper part of the protecting mechanism, the upper part has an external surface engaged with all the inner surface of the cavity.

18. The connector in accordance with claim 15, wherein the actuator is formed with a stopper, the stopper engagingly mating with protecting mechanism to restrain rotating of the actuator in a predetermined phase range.

19. The connector in accordance with claim 18, wherein the stopper of the actuator is located in the hole of the protecting mechanism when the connector is fully assembled.

* * * * *